US010246816B2

(12) United States Patent
Date

(10) Patent No.: US 10,246,816 B2
(45) Date of Patent: Apr. 2, 2019

(54) STEAM IRON WITH PRESSURIZED WATER RESERVOIR

(71) Applicant: KONINKLIJKE PHILIPS N.V., Eindhoven (NL)

(72) Inventor: Milind Vishwas Date, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 16/075,770

(22) PCT Filed: Mar. 2, 2017

(86) PCT No.: PCT/EP2017/054945

§ 371 (c)(1),
(2) Date: Aug. 6, 2018

(87) PCT Pub. No.: WO2017/149090

PCT Pub. Date: Sep. 8, 2017

(65) Prior Publication Data

US 2019/0040570 A1 Feb. 7, 2019

(30) Foreign Application Priority Data

Mar. 4, 2016 (EP) ..... 16158728

(51) Int. Cl.

| | |
|---|---|
| ***D06F 75/12*** | (2006.01) |
| ***D06F 75/14*** | (2006.01) |
| ***D06F 79/02*** | (2006.01) |

(52) U.S. Cl.

CPC ..... *D06F 75/12* (2013.01); *D06F 75/14* (2013.01); *D06F 79/02* (2013.01); *D06F 79/026* (2013.01)

(58) Field of Classification Search

CPC ..... D06F 75/00; D06F 75/40; D06F 70/00; D06F 70/02; D06F 70/026; H05B 1/02; H05B 1/0255; H05B 1/0269

See application file for complete search history.

(56) References Cited

U.S. PATENT DOCUMENTS 1,697,224 A 1/1929 Butman
2,714,650 A * 8/1955 Werner ..... D06F 79/026 219/247

(Continued)

FOREIGN PATENT DOCUMENTS

DE 3544506 A1 6/1987
DE 19524333 C1 8/1996

(Continued)

*Primary Examiner* — Ismael Izaguirre

(57) ABSTRACT

The present application relates to a steam iron (1) for treating garments, comprising a heel (2) to rest the steam iron (1) on a supporting surface (S) when the steam iron (1) is not treating garments, a pressurization unit (3) having a chamber (4) comprising a water inlet (5) for receiving water and a water outlet (6). The pressurization unit (3) is adapted so that, in a rest position (PI) where the heel (2) is placed on the supporting surface (S), it generates an air vacuum in the chamber (4) to draw water into the chamber (4) via the water inlet (5) and, in a lifted position (P2) where the heel (2) is not placed on the supporting surface (S), pressurizes the water drawn in the chamber (4). The steam iron also comprises a steam engine (7) for generating steam from water towards the garments and a water output channel (8) for carrying water under pressure from the water outlet (6) to the steam engine (7). This invention allows easily pressurizing the water in the chamber for in turn increasing the steam generation.

14 Claims, 8 Drawing Sheets

(56) References Cited

U.S. PATENT DOCUMENTS

| | | | | | |
|---|---|---|---|---|---|
| 2,749,633 | A * | 6/1956 | Seck | D06F 75/18 | 38/77.1 |
| 3,492,459 | A * | 1/1970 | Schwartz | D06F 75/26 | 219/251 |
| 4,837,952 | A * | 6/1989 | Hennuy | D06F 75/18 | 38/77.7 |
| 5,074,066 | A * | 12/1991 | Sakano | D06F 75/18 | 219/247 |
| 5,638,622 | A * | 6/1997 | Hohn | D06F 75/18 | 38/77.5 |
| 6,622,404 | B2 * | 9/2003 | Valiyambath | D06F 75/02 | 38/77.8 |
| 7,603,800 | B2 | 10/2009 | Kuebert | | |
| 8,056,272 | B2 * | 11/2011 | Rosenzweig | A47L 11/34 | 38/77.8 |
| 2002/0029498 | A1 | 3/2002 | Harrison | | |
| 2008/0229628 | A1 | 9/2008 | Valiyambath | | |

FOREIGN PATENT DOCUMENTS

| | | | |
|---|---|---|---|
| EP | 315915 | A1 | 5/1989 |
| EP | 2175066 | A1 | 4/2010 |
| JP | 02305600 | A | 12/1990 |
| JP | 11290596 | A | 10/1999 |
| JP | 2004159897 | A | 6/2004 |
| WO | 2005080664 | A1 | 9/2005 |
| WO | 2006008576 | A1 | 1/2006 |

* cited by examiner

STEAM IRON WITH PRESSURIZED WATER RESERVOIR

This application is the U.S. National Phase application under 35 U.S.C. § 371 of International Application No. PCT/EP2017/054945, filed on Mar. 2, 2017, which claims the benefit of International Application No. 16158728.2 filed on Mar. 4, 2016. These applications are hereby incorporated by reference herein.

FIELD OF THE INVENTION

The present invention relates to garment care appliances for treating garments, in particular to a steam iron with pressurized water reservoir.

BACKGROUND OF THE INVENTION

Steam irons have a heated soleplate that contacts a garment during ironing. A steam engine in the soleplate is supplied with water under the force of gravity to produce steam that exits the soleplate through a steam vent or a number of steam vents towards a garment during ironing to improve ironing performance.

It is understood that ironing performance is further improved when the steam exiting the steam vent(s) is at a relatively high pressure. However, steam pressure and quantity of steam is limited by the amount of water that can be supplied to the soleplate under gravitational force. The steam generated in the steam engine also creates a back pressure which opposes the flow of water into the steam generator, resulting in reduced steam production.

It is known to increase the quantity and pressure of the steam by generating steam in a boiler outside the iron and supplying it to the iron through a flexible hose, or by using a pump to supply water under pressure into the steam engine. However, these solutions are not always appropriate or desirable and cannot be used if, for example, the iron is a cordless version that does not have a direct power supply or steam conduit connected to the iron.

JP H02 305600 describes delivering a force of water high enough to allow the generation of high power steam by providing a pressurizing pump which pressurizes a space in a water tank when an iron body is mounted in an iron stand. When, after water is poured in a water tank, the water tank is mounted to an iron body and is set on an iron stand, a source feed circuit is actuated to start energization to a heater. In this case, a pressurizing pump is also actuated to push up the ball valve of a suction port and air is fed in the water tank to effect pressurization. When, after the heater is heated, the use of the iron is started, a space at the upper interior of the water tank forms an air reservoir and a pressure higher than an atmospheric pressure is generated in the space and therefore, a pressure is exerted on water in the water tank. When, with this state, a push button is depressed, a water passage on-off valve is opened, water is pushed out with a force in a gasifying chamber through a nozzle through the action of the pressure in the water tank. The water instantaneously produces steam and is injected as high power steam through an iron base.

DE3544506 describes the formation of a light currentless and cordless storage-type dry and steam-regulating iron with an open handle, which is designed with a storage fluid of high capacity and low specific gravity and with a store and pre-stored push-in storage elements and a steam-superheating generator and hot-water pressure vessel which can be lifted off automatically, and a tiltably arranged hot-water pressure spray nozzle with a tilting inflow shut-off valve and, in addition, with automatic vacuum-suction and pressurized-water feed.

US2002/029498 describes a rapid cool iron having a body and a low specific heat sole plate having an element bonded to or formed upon a top surface, said body and said sole plate being separated by an air gap to allow for the free flow of air over said top surface of said sole plate. Also described is a fan to more rapidly cool the sole plate through forced convection. Also described is a controller that is configured to only apply power when the rapid cool iron is in a horizontal orientation. Also described is a steam generator which may be independent from or integrated with the sole plate, an external water reservoir/stand which includes a water filter, an ergonomically designed tilt handle with integrated controls and a grip sensor, and a forward facing light to illuminate the material being ironed.

DE19524333 describes a steam iron having an electronic control system which detects which of the separate water consumption units is switched on through the timing of pressure changes in the pressure store. The electronic control switches the pump off after a preset maximum time if a given water consumption unit, the additional steaming chamber, is switched on.

US2008/229628 describes a steam ironing device comprising a steam generator for heating water to steam, a steam outlet for letting out a burst of steam from the steam generator, a device for supplying water to the steam generator, a hose connecting the water supplying device to the steam generator, and a controller which is adapted to operating the water supplying device during a period of time in a situation in which there is hardly any need or no need at all of a supply of steam in an ironing process, while keeping the steam outlet closed. In this way, a reserve amount of steam is generated, which is stored in an internal space of the steam generator, and, as the occasion arises, inside at least a portion of the hose. When a burst of steam is required, the reserve amount of steam is released through the steam outlet.

U.S. Pat. No. 1,697,224 A describes an electric iron having incorporated therein manually controlled means by which steam can be generated as desired and applied to the cloth or garment during the normal pressing operation of the sad iron, whereby a combined steaming and pressing of the cloth can be effected conveniently and expeditiously and to the elimination of the old method of employing a wet cloth for dampening.

SUMMARY OF THE INVENTION

It is an object of the invention to provide a steam iron for treating garments which substantially alleviates or overcomes one or more of the problems mentioned above.

The invention is defined by the independent claims. The dependent claims define advantageous embodiments.

According to the present invention, there is provided a steam iron for treating garments, comprising:

- a heel to rest the steam iron on a supporting surface when the steam iron is not treating garments,
- a pressurisation unit having a chamber, the chamber comprising a water inlet for receiving water and a water outlet, the pressurisation unit being adapted to:
  - a) in a rest position where the heel is placed on the supporting surface, generate an air vacuum in the chamber to draw water into the chamber via the water inlet, b) in a lifted position where the heel is not placed on the supporting surface, pressurise the water drawn in the chamber, a steam engine for generating steam from water towards the garments, a water output channel for carrying water under pressure from the water outlet to the steam engine.

This solution allows pressurizing water without specific user manual action on the iron. Water can then be supplied under pressure to the steam generator without the use of a separate boiler or pump mechanism. Therefore, a higher rate of flow of steam is provided through the steam vents to improve ironing performance.

In a preferred embodiment, the pressurisation unit comprises a piston that slides within the chamber in a first direction to create the air vacuum within the chamber. A retention member is located in the chamber to exert a force on the piston in a second direction, opposite to the first direction.

By providing a slidably mounted piston within a chamber, a vacuum pressure can be easily generated as a result of movement of the piston within the chamber. Sliding of the piston in the first direction occurs against a force provided by a retention member that urges the piston in the opposite direction when the steam iron is in its lifted position and pressurises the water drawn into the chamber.

The retention member may be a compression spring that is compressed when the steam iron is in its rest position and released when the steam iron is in its lifted position.

In another embodiment, the chamber resiliently deforms in the rest position to create a vacuum in the chamber.

This solution results in a simplified implementation as no piston is required.

Hence, in specific embodiments the steam iron comprises a mechanical energy storing element. The mechanical energy storing element stores energy when the steam iron is brought in a rest position (on the supporting surface). When brought in the rest position, a pusher element induces the storage of the mechanical energy in the mechanical energy storing element. For instance, the pusher element may push against the mechanical energy storing element. The pusher element is functionally coupled with the mechanical energy storing element. When the steam iron is lifted from the supporting surface, i.e. brought in a lifted position, at least part of the mechanical energy is used to pressurize the water in the chamber. In this way, the water is pressurized and may be expelled from the steam iron with an increased pressure.

The mechanical energy storing element may in embodiments comprise a compression spring. Such compression spring may especially be functionally coupled to a piston. The mechanical energy storing element may comprise in embodiments a deformable element capable of resiliently deforming and storing energy when in a compressed state. The mechanical energy storing element may in embodiments comprise a wall, or a part of the wall, of the chamber, which wall or part of the wall is adapted to resiliently deform.

The pusher element may especially be configured to provide such mechanical energy to the mechanical energy storing element only by the action of mechanically pushing the mechanical energy storing element. This may be achieved in embodiments by bringing the steam iron in its rest position. Hence, in embodiments no additional pump or electronics are necessary (though are in embodiments not excluded) to have the pressurisation unit pressurise the water (drawn) in the chamber. When bringing the steam iron in its rest position, the pusher element is pushed by which mechanical energy is transferred to the mechanical energy storing element. The pusher element is especially configured for a translational movement, by which from external of the steam iron the pusher element can be pushed against the mechanical energy storing element. The pusher element is especially movably coupled with the steam iron, more especially the pressurisation unit.

In embodiments, the pusher element can be pushed by arranging the steam iron on any flat supporting surface. In yet other embodiments, the pusher element can only partly be pushed by arranging the steam iron on any flat supporting surface, but can be fully pushed by arranging the steam iron on a docking station (configured for receiving such steam iron). In yet further embodiment, the pusher element can only be fully pushed by arranging the steam iron on a docking station (configured for receiving such steam iron).

Therefore, the steam iron, more especially the pressurisation unit may comprise the mechanical energy storing element. Further, the steam iron, more especially the pressurisation unit, may comprise the pusher element. The pusher element may be functionally coupled, such as in embodiments mechanically coupled, to the mechanical energy storing element.

Preferably, a one-way valve is disposed along the water output channel to allow water to flow in direction of the steam engine.

The one way valve in the output channel prevents water from being drawn back along the water output channel when an air vacuum is generated in the chamber.

The one-way valve in the output channel may be adapted to be opened based on a user action.

By enabling the valve to be opened manually, a user may control the supply of water from the chamber to the steam generator in order to generate steam. This means that steam is generated only when required by a user.

Alternatively, the one-way valve in the output channel is adapted to self-open in the lifted position.

This makes using the iron easier as a user does not have to manually activate the valve to control the water supply to the steam engine in order to generate steam.

In a preferred embodiment, the pressurisation unit comprises a pusher element connected to the piston, the pusher element extending beyond the heel when the retention member is released.

The pusher element controls movement of the piston so that it will slide within the chamber as a result of placing the steam iron in the rest position due to it making contact with the supporting surface and the weight of the steam iron acting against it.

The steam iron preferably has a water reservoir and a water input channel for carrying water from the water reservoir to the chamber via the water inlet in the rest position and under the action of the pressurisation unit.

The water reservoir is in fluid communication with the chamber so that the air vacuum causes water to flow from the water reservoir into the chamber for subsequent pressurisation in the chamber when the iron is in its lifted position.

According to another aspect of the invention, there is provided a steam iron system comprising a steam iron according to the invention and a docking station defining the supporting surface for detachably resting the steam iron.

In some embodiments, the steam iron of the steam iron system comprises a water reservoir, and a water input channel for carrying water from the water reservoir to the chamber via the water inlet in the rest position and under the action of the pressurisation unit.

In other embodiments, the docking station comprises a water reservoir, the steam iron and the docking station each including a fluid coupling cooperating when the steam iron is in the rest position, for carrying water from the water reservoir to the chamber via the water inlet in the rest position and under the action of the pressurisation unit.

By providing the water reservoir in the docking station instead of in the steam iron itself, the steam iron is simplified and its weight reduced. The water reservoir may also be made larger if it is in the docking station so that it does not need to be refilled so often.

Advantageously, the steam iron comprises an inlet valve arranged between the reservoir and the chamber. The inlet valve prevents water in the chamber from flowing back to the reservoir when the steam iron is in lifted position.

In a preferred embodiment, the steam iron comprises an electric heater in thermal conductivity with the steam engine, the docking station comprises a power supply, the steam iron and the docking station having electrical connectors cooperating with each other to provide electrical supply to the electric heater when the steam iron is in the rest position.

The electric heater is supplied with power when the iron is in its rest position on the supporting surface of the docking station via a supply connected to the docking station.

In the rest position, this allows storing thermal energy in the iron. In the lifted position, the stored thermal energy is used by the steam engine to generate steam.

Advantageously, the inlet valve is further adapted to regulate the flow of water from the water reservoir into the chamber when the steam iron is in the rest position. The docking station comprises a valve actuator adapted to cooperate with the inlet valve for varying the opening of the inlet valve when the steam iron is the rest position.

These and other aspects of the invention will be apparent from and elucidated with reference to the embodiments described hereinafter.

BRIEF DESCRIPTION OF THE DRAWINGS

Embodiments of the invention will now be described, by way of example only, with reference to the accompanying drawings, in which.

DETAILED DESCRIPTION OF THE EMBODIMENTS

Figure 1A:
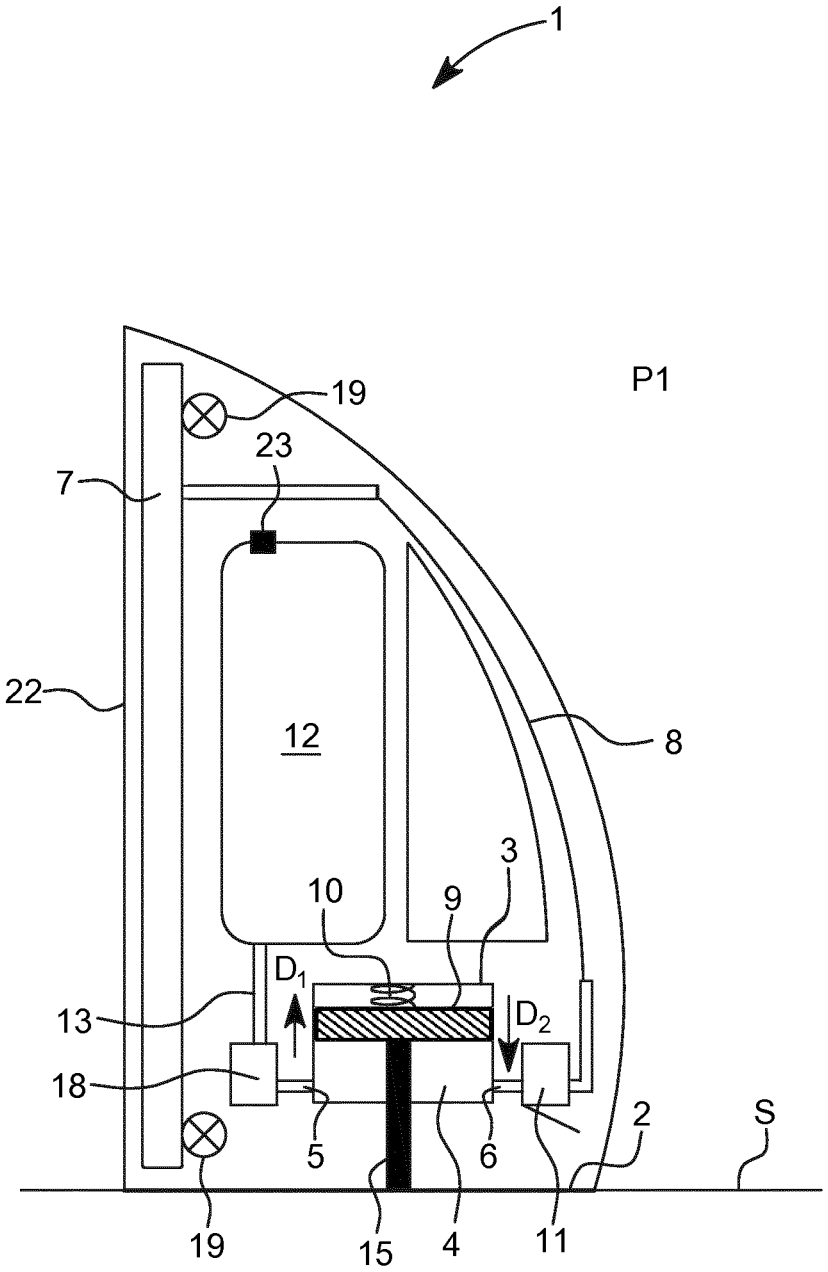
FIG. 1A shows a first steam iron according to the invention for treating garments in a rest position (P1) on a supporting surface.
Figure 1B:
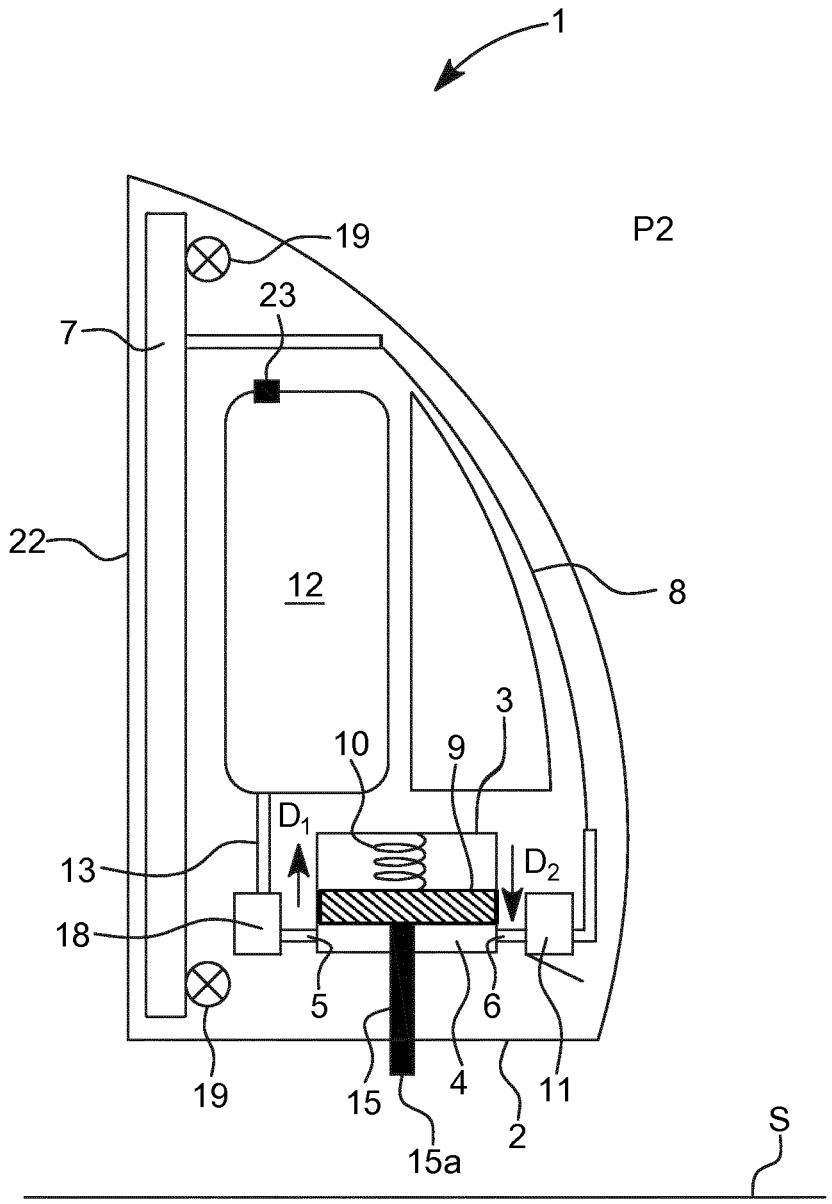
FIG. 1B shows the first steam iron of FIG. 1A in a lifted position (P2)

With reference to FIGS. 1A and 1B, there is shown a steam iron 1 for treating garments according to a first embodiment of the present invention The steam iron comprises a heel 2 to rest the steam iron 1 on a supporting surface S in rest position (P1) as shown in FIG. 1A when the steam iron 1 is not being used to treat garments.

The steam iron 1 further comprises a pressurisation unit 3 having a chamber 4 including a water inlet 5 for receiving water and a water outlet 6.

The pressurisation unit 3 is adapted to generate an air vacuum in the chamber 4 to draw water into the chamber 4 via the water inlet 5, when the iron 1 is in its rest position P1, as shown in FIG. 1A, with the heel 2 placed on the supporting surface S.

The pressurisation unit 3 is also adapted to pressurise the water drawn into the chamber 4, when the iron 1 is lifted off the supporting surface S in lifted position (P2) as shown in FIG. 1B, and the heel 2 is no longer contacting with the supporting surface S.

The steam iron 1 also comprises a steam engine 7 for generating steam from water and for directing it towards the garments through vents (not shown) formed in a soleplate 22, and a water output channel 8 for carrying water under pressure from the water outlet 6 to the steam engine 7.

The pressurisation unit 3 comprises a piston 9 received in the chamber 4. The piston 9 forms a sliding seal against the chamber wall to prevent water and/or air from passing around the edges of the piston 9.

When the steam iron 1 is placed on its heel 2 in the resting position (P1), the piston 9 slides in a first direction D1 away from the supporting surface S. Sliding of the piston 9 in the first direction D1 creates an air vacuum in the chamber 4 in a first region of the chamber 4 beneath the piston 9, which causes water to be drawn into the first region of the chamber 4 through the water inlet 5.

The steam iron comprises a water reservoir 12, and a water input channel 13 for carrying water from the water reservoir 12 to the chamber 4 via the water inlet 5 in the rest position (P1) and under the action of the pressurisation unit 3.

From usage point of view, the water reservoir 12 is regularly and manually filled-in by user.

A pusher element 15 preferably extends from the piston 9 through an opening in a wall of the chamber 4. The pusher element 15 may be a cylindrical rod or shaft that can slide in an axial direction through the opening relative to the chamber wall. A sliding seal may be provided between the pusher element 15 and the chamber wall to prevent the passage of air into the chamber 4 when the piston 9 is displaced or, the escape of water drawn into the chamber 4. The pusher element 15 extends through and beyond the heel 2 of the steam iron 1 when the steam iron 1 is in its lifted position (P2), as illustrated in FIG. 1B.

As the pusher element 15 protrudes beyond the heel 2 of the steam iron 1 in its lifted position (P2), the protruding end 15*a* of the pusher element 15 will make initial contact with the supporting surface S when the steam iron 1 is placed on its heel 2 in its rest position (P1), and the pusher element 15 will then take all the weight of the steam iron 1. The pusher element 15 thus exerts a downwards force on the supporting surface S. In turn, an opposite upwards force is exerted on the piston 9 which is then pushed upwards inside the chamber 4. The weight of the steam iron 1 acting in a direction towards the supporting surface S causes the pusher element 15 to slide inwardly until the protruding end 15*a* of the pusher element 15 is level or flush with the surface of the heel 2.

A retention member 10 is arranged in a second region of the chamber 4 above the piston 9.

The retention member 10 is preferably constrained between the piston 9 and the chamber wall and is resiliently compressed as the piston 9 slides in the first direction D1 when the steam iron 1 is placed on its heel 2 on the supporting surface S, so that it exerts a force on the piston 9 in direction opposite to the first direction D1.

The retention member 10 may be a compression spring or a deformable element capable of resiliently deforming and storing energy when in a compressed state.

It will be appreciated that the force generated by the retention member 10 against the piston 9 is not sufficient to prevent the piston 9 from sliding in direction D1 under the weight of the steam iron 1 when the heel 2 is placed on the supporting surface S in its rest position (P1).

When the steam iron 1 is in its lifted position P2 and the heel 2 is no longer in contact with the supporting surface S, the pusher element 15 is free from the supporting surface S and retention member 10 is released. The stored mechanical energy within the retention member 10 acts against the piston 9 to urge it back in an opposite direction D2. The water drawn into the region of the chamber 4 beneath the piston 9 when the heel 2 was placed on the supporting surface in a rest position (P1), is now pressurised by the piston 9 due to the force of the retention member 10 acting against it.

A one-way valve 11 controls the flow of water from the water outlet 6 of the chamber 4 to the steam engine 7 through the water output channel 8.

The one way valve 11 is closed when the steam iron 1 is placed on its heel 2 on the supporting surface S in its rest position so that an air vacuum can be generated in the chamber 4 to drawn water into the chamber 4, rather than from the water output channel 8.

The one-way valve 11 can be a mechanical valve that is manually operated by a user as required (in order to trigger the steam generation), or it can open automatically when the steam iron 1 is raised into its lifted position (P2).

The one-way valve 11 may open when the steam iron 1 is pivoted into a position in which the soleplate 22 is substantially horizontal so that no user intervention to operate the valve 11 is required. This also ensures safer and effective steam generation as the steam is only generated when the steam iron 1 is in an orientation in which ironing occurs, i.e. when the steam iron 1 is held with its soleplate 22 in a substantially horizontal orientation for ironing garments placed on a horizontal ironing board.

If the steam iron is equipped with a source of electrical energy (for example a rechargeable battery), it is also envisaged that the valve 11 can be controlled by an electrical signal reflecting a choice input to the steam iron 1 by a user.

A user may be able to make an initial selection as to when they wish the valve 11 to open, or whether they wish to be able to open it manually. Once chosen, their selection may be stored in a memory and the steam iron 1 may operate according to that selection until the user changes it once again.

In a preferred embodiment, the one-way valve 11 opens in response to operation of a switch or trigger (not shown) by a user so that steam is produced on demand.

A one way inlet valve 18 is preferably arranged at the entrance of the water inlet 5. The inlet valve 18 controls the flow of water from the reservoir 12 into the chamber 4 through the water inlet 5.

The inlet valve 18 may be a check valve that self-opens as a result of the generation of a vacuum in the chamber 4 when the steam iron 1 is placed on its heel 2 on a supporting surface S in its rest position (P1), so that water can be drawn from the reservoir 12 through the water inlet 5 and into the chamber 4 as the piston 9 is displaced in direction D1.

The inlet valve 18 closes when a vacuum is no longer generated in the chamber 4 and, in particular, when the steam iron 1 is in its lifted position (P1) and water in the chamber 4 is pressurised by the retention member 10 acting against the piston 9.

Closure of the inlet valve 18 prevents a reverse flow of water back out of the chamber 4 through the inlet 5 towards the reservoir 12.

The inlet valve 18 may be open but close only in response to a back pressure acting in a direction towards the reservoir 12, i.e. it may be responsive to a pressure differential across the valve 18 which causes it to close.

Alternatively, the inlet valve 18 may open, or open wider, in response to the generation of a vacuum within the chamber 4.

The reservoir 12 and 12A may include a balancing valve 23 and 23A, respectively, to allow the flow of air into the corresponding reservoir, as water is drawn out of the reservoir into the chamber 4. This ensures that water flows out of the chamber 4 smoothly and prevents any vacuum being generated in the reservoir as a result of water flowing into the chamber 4 under the influence of the air vacuum.

During use of a steam iron according to the invention, whilst a user may realise that the steam pressure has reduced or is no longer present reflecting that water needs to be re-filled and/or thermal energy needs to be accumulated by docking back on the docking station, user will also be able to gauge when the steam iron 1 needs to be put back in the rest position (P1) by looking at the position of the pusher element 15 and the extent to which it is protruding from the heel 2 of the steam iron 1.

Figure 2A:
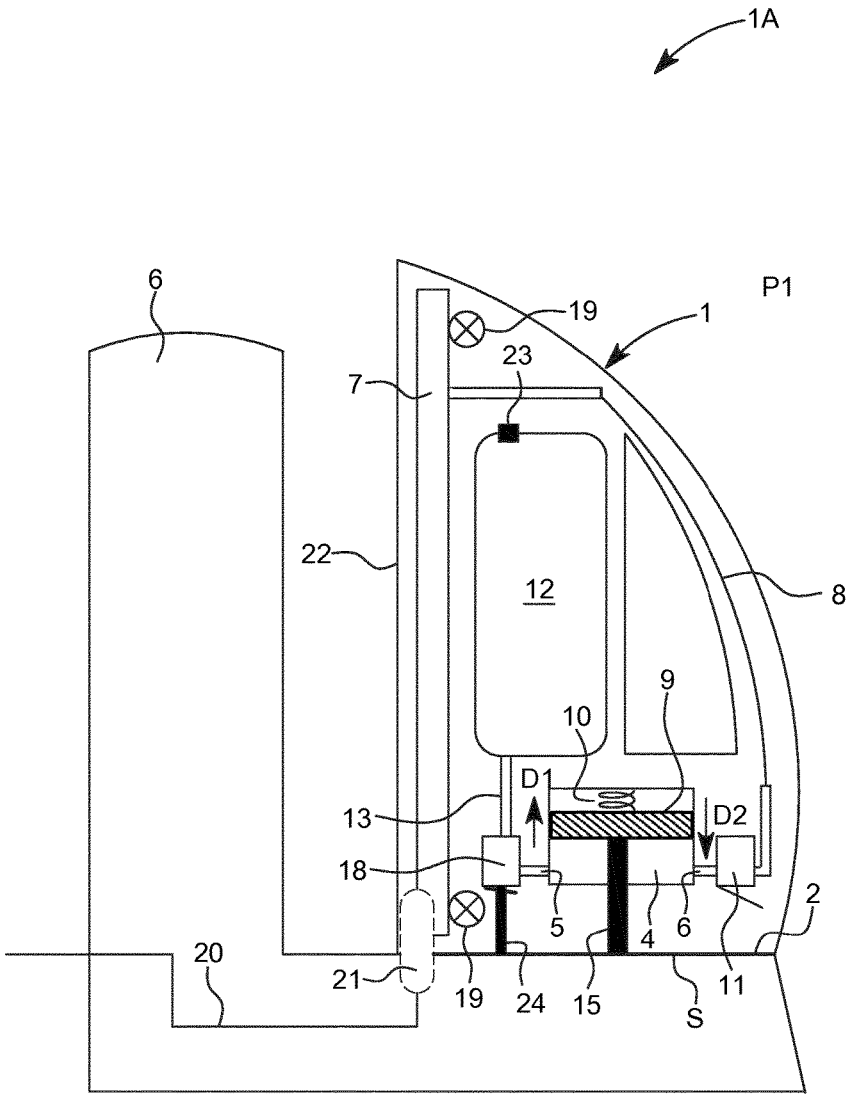
FIG. 2A shows a first steam iron system according to the invention of a steam iron for treating garments in a rest position (P1) on a supporting surface of a docking station.
Figure 2B:
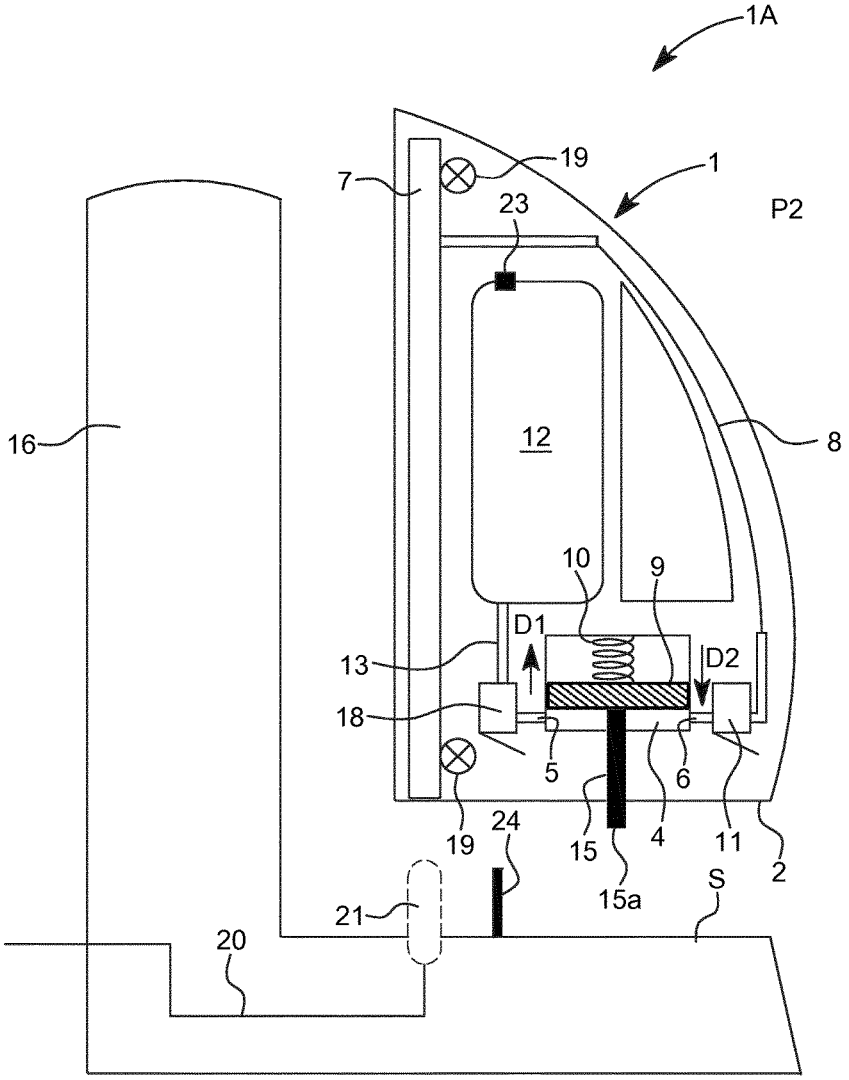
FIG. 2B shows the first steam iron system in a lifted position (P2)

A first steam iron system 1A is shown in FIGS. 2A and 2B, which demonstrates how an embodiment of the invention may be employed with a "cordless" steam iron 1 that is placed on a docking station 16 when not in use for ironing garments, and in which the cordless steam iron 1 and docking station 16 together form a steam iron system. For sake of clarity, term "cordless" refers to the fact that when in the lifted position (P2), there are no cord connections between the steam iron and the docking station 16.

In this embodiment, the supporting surface S is provided on the docking station 16.

In FIG. 2A, a steam iron 1 is shown in its rest position (P1) in which the heel 2 of the steam iron 1 is placed on the supporting surface S of the docking station 16.

FIG. 2B is the same view, except that the cordless steam iron 1 has been raised off the supporting surface S of the docking station 16 into its lifted position (P2).

The steam iron 1 according to the second embodiment may function in a similar way as previously described.

The supporting surface S of the docking station 16 is preferably provided with a valve actuator 24 that cooperates with the inlet valve 18 when the steam iron 1 is placed on the supporting surface S to open the inlet valve 18 rather than as a result of a pressure differential across the valve 18.

Removal of the steam iron 1 from the supporting surface S will then disengage the valve actuator 24 from the inlet valve 18 thereby causing the valve 18 to close.

The supporting surface S of the docking station 16 may also be provided with electrical connectors 21 having terminals for supplying electrical energy to the steam iron 1 to heat the soleplate 22 and/or steam engine 7 when the steam iron 1 is placed on the supporting surface S.

Although FIGS. 2A and 2B show that the water reservoir 12 is positioned within the steam iron 1, it is also possible instead to locate a reservoir 12A in the docking station 16. A fluid coupling 17 is thus provided between the steam iron 1 and the docking station 16 that fluidly couples the steam iron 1 to the reservoir 12A when the steam iron 1 is placed on the supporting surface S.

Figure 3:
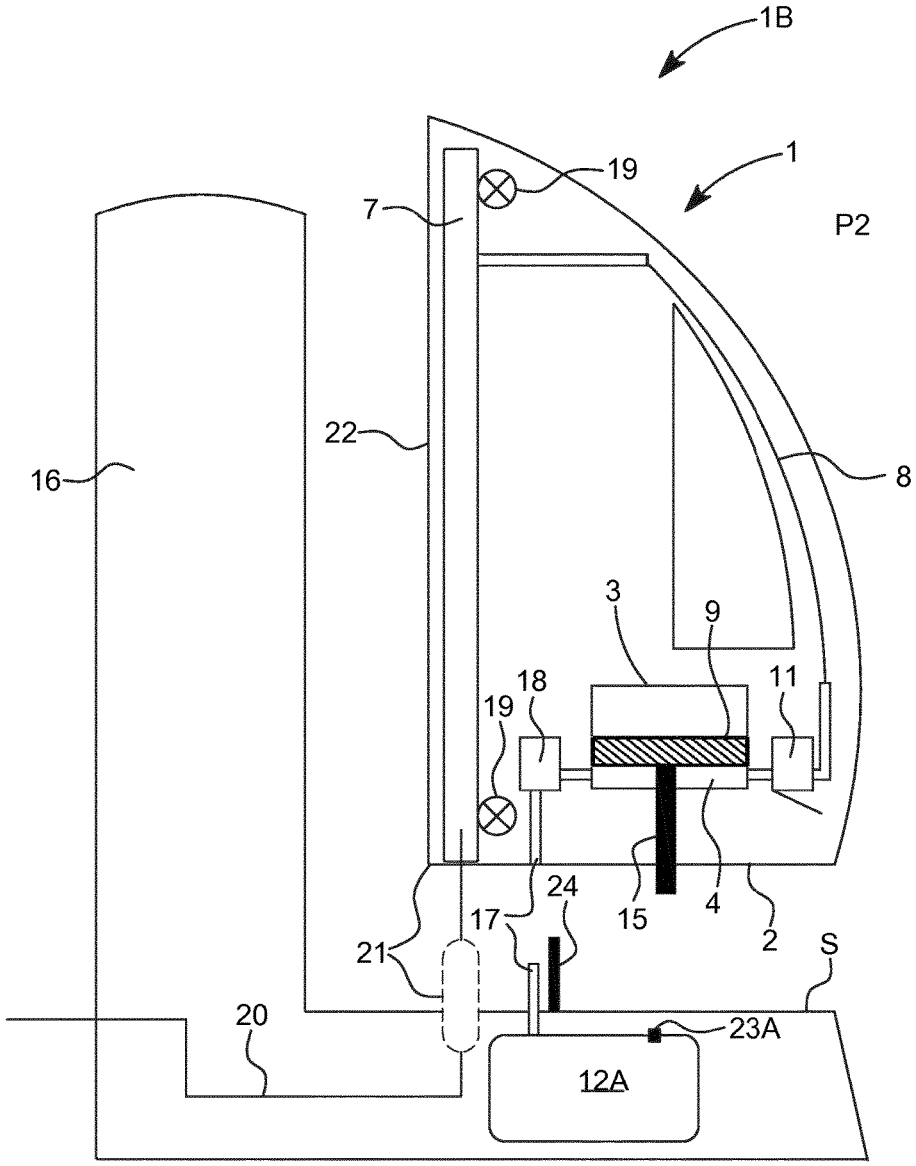
FIG. 3 shows a second steam iron system according to the invention in a lifted position (P1) above a supporting surface of a docking station.

Such an arrangement with the reservoir 12A located in the docking station 16 is shown in FIG. 3, which shows a second steam iron system 1B in which the steam iron 1 in a lifted position (P1) above a supporting surface S of a docking station 16.

Figure 4:
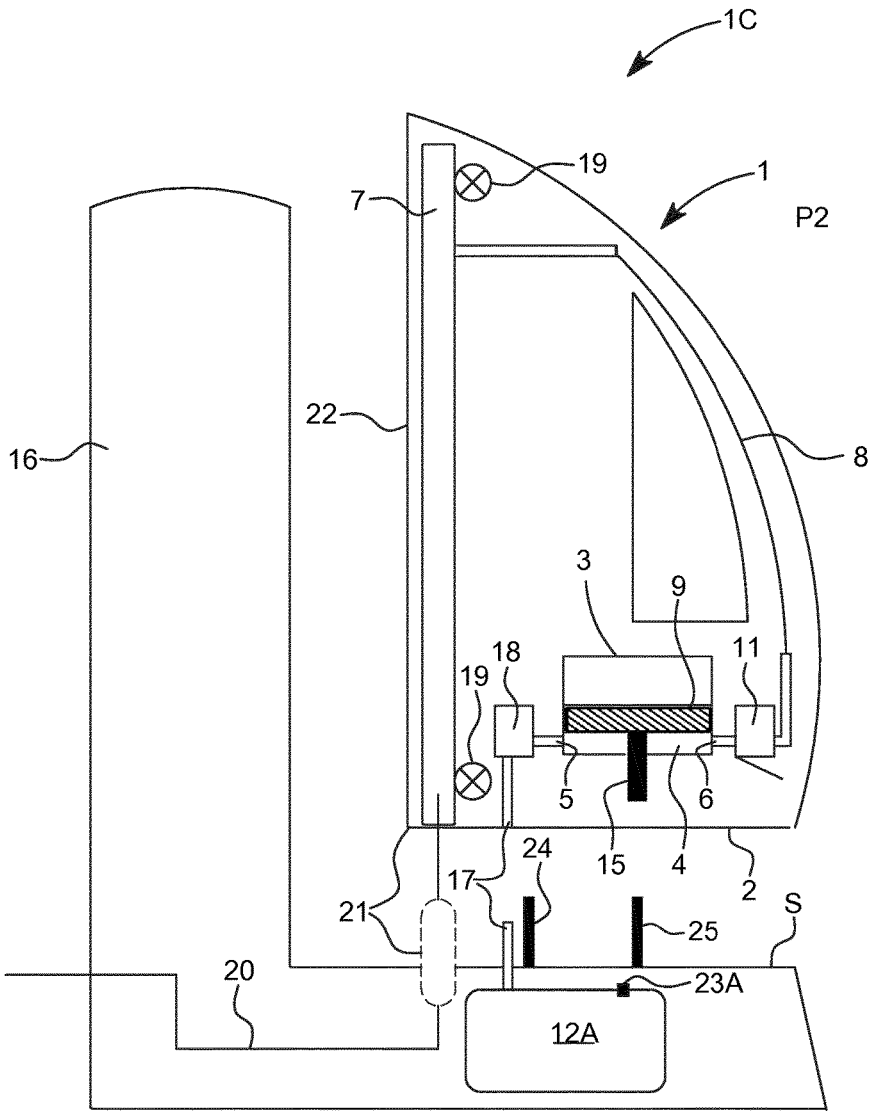
FIG. 4 shows a third steam iron system according to the invention in a lifted position (P1) above a supporting surface of a docking station.

A third steam iron system 1C is shown in FIG. 4.

In this embodiment, rather than having the pusher member 15 extending out of the steam iron beyond the heel 2, it is made shorter so that it remains wholly within the steam iron 1 and does not protrude from it. An additional pushing element 25 upstands from the supporting surface S of the docking station 16. When the steam iron 1 is placed on the supporting surface S, the pushing element 25 extends into the steam iron 1 through an opening (not shown) in the heel 2 and contacts the pusher member 15 to drive the piston 9 in direction D1 within the chamber 4.

Although the pushing element 25 may be fixed, it may also be mounted so that it held within the docking station 16 below the supporting surface S until the steam iron 1 is placed on the supporting surface S, at which point it raises so as to protrude beyond the supporting surface S and into the steam iron 1.

Although the reservoir 12A is shown within the docking station 16 in the embodiment of FIG. 4, it will be appreciated that it can also be located within the steam iron 1, as previously described.

Figure 5A:
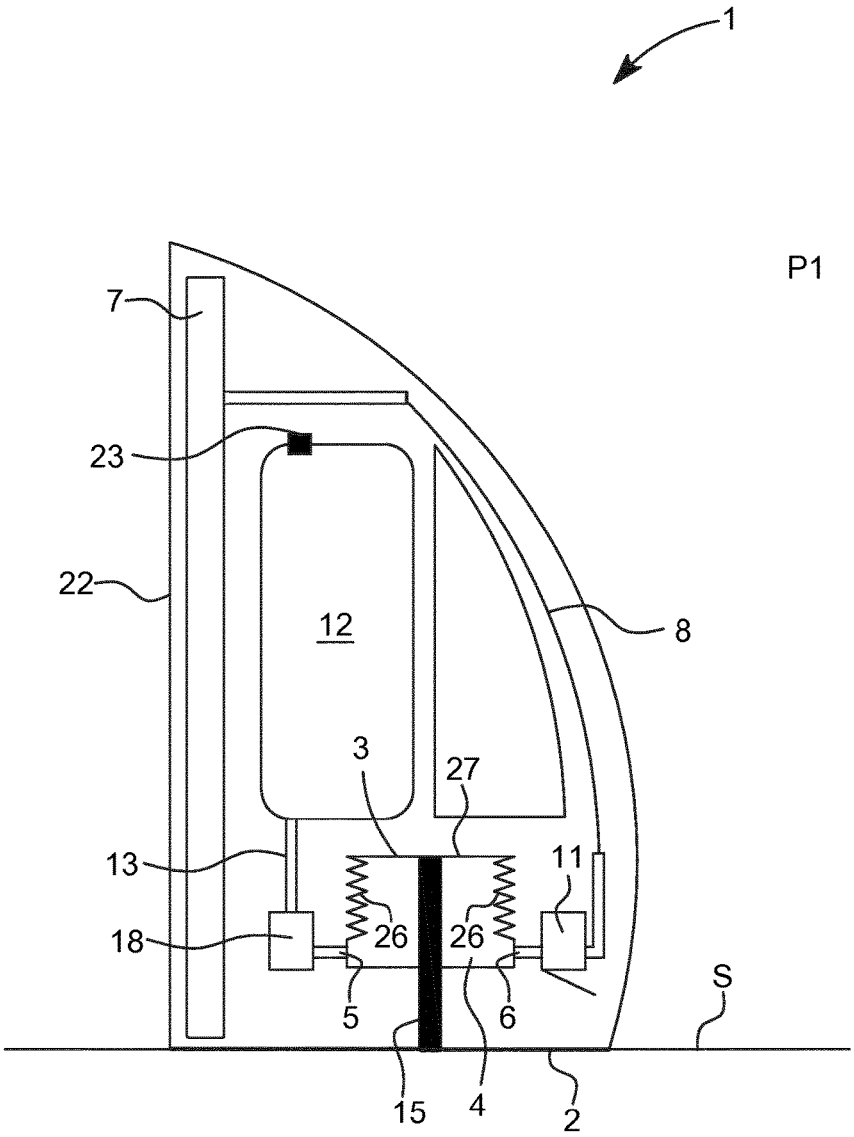
FIG. 5A shows a second steam iron according to the invention in a rest position (P1)
Figure 5B:
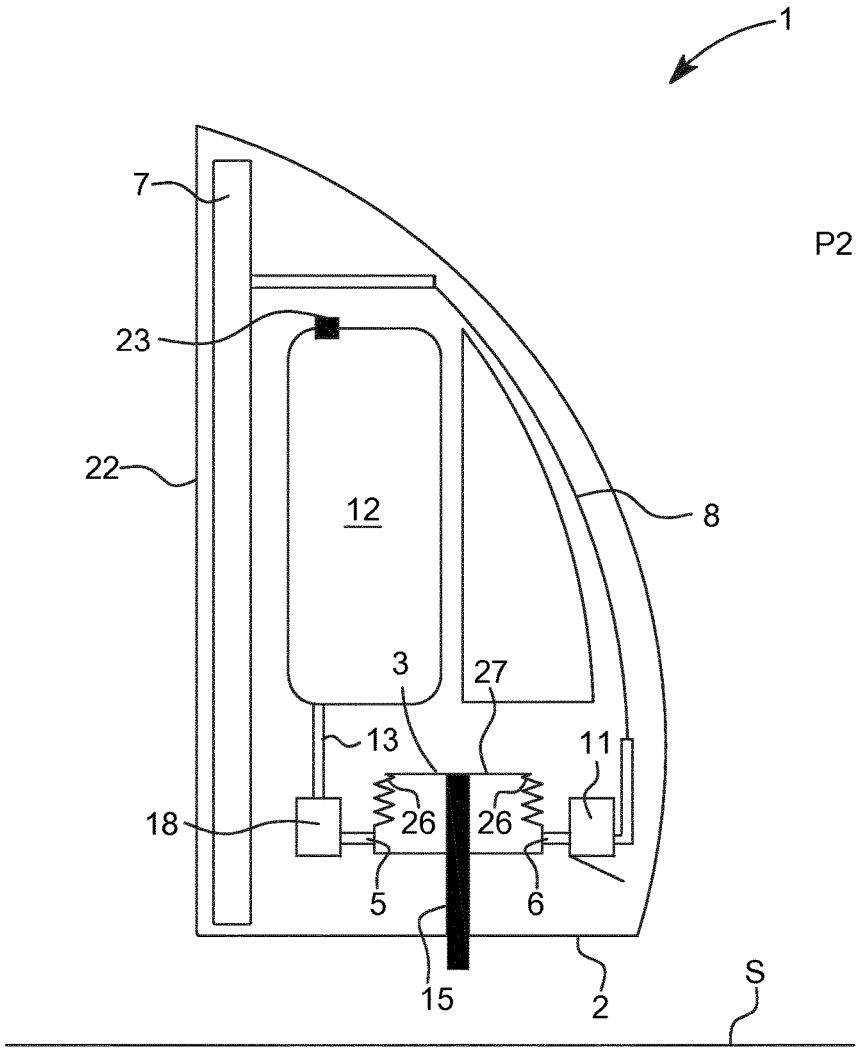
FIG. 5B shows the second steam iron in a lifted position (P2).

A second embodiment of a steam iron 1 is illustrated in FIGS. 5A and 5B, in which the pressurisation unit 3 described with reference to all of the previous embodiments may have a different construction.

Rather than having a piston 9 sliding inside the chamber, the pressurisation unit 3 has walls adapted to resiliently deform.

For example, the pressurisation unit 3 can take the form of an expandable bellows 26.

FIG. 5A shows the steam iron 1 in the rest position (P1) in which the pusher member 15, which is attached to an upper wall 27 of the chamber 4 has been forced inwardly under the weight of the iron 1 acting against the pusher member 15, and the bellows 26 have been extended to create a vacuum and draw water into the chamber 4 from the reservoir 12.

FIG. 5B shows the steam iron 1 raised into its lifted position (P2). The resilience of the bellows 26 pressurises the water within the chamber 4 as the bellows 26 return back into their original configuration.

The above embodiments as described are only illustrative, and not intended to limit the technique approaches of the present invention. Although the present invention is described in details referring to the preferable embodiments, those skilled in the art will understand that the technique approaches of the present invention can be modified or equally displaced without departing from the scope of the technique approaches of the present invention, which will also fall into the protective scope of the claims of the present invention. In the claims, the word "comprising" does not exclude other elements or steps, and the indefinite article "a" or "an" does not exclude a plurality. Any reference signs in the claims should not be construed as limiting the scope.

The term "substantially" herein, such as in "substantially consists", will be understood by the person skilled in the art. The term "substantially" may also include embodiments with "entirely", "completely", "all", etc. Hence, in embodiments the adjective substantially may also be removed. Where applicable, the term "substantially" may also relate to 90% or higher, such as 95% or higher, especially 99% or higher, even more especially 99.5% or higher, including 100%. The term "comprise" includes also embodiments wherein the term "comprises" means "consists of". The term "and/or" especially relates to one or more of the items mentioned before and after "and/or". For instance, a phrase "item 1 and/or item 2" and similar phrases may relate to one or more of item 1 and item 2. The term "comprising" may in an embodiment refer to "consisting of" but may in another embodiment also refer to "containing at least the defined species and optionally one or more other species".

Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

The devices herein may amongst others described during operation. As will be clear to the person skilled in the art, the invention is not limited to methods of operation or devices in operation.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "to comprise" and its conjugations does not exclude the presence of elements or steps other than those stated in a claim. Unless the context clearly requires otherwise, throughout the description and the claims, the words "comprise", "comprising", and the like are to be construed in an inclusive sense as opposed to an exclusive or exhaustive sense; that is to say, in the sense of "including, but not limited to". The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention further applies to a device comprising one or more of the characterizing features described in the description and/or shown in the attached drawings. The invention further pertains to a method or process comprising one or more of the characterizing features described in the description and/or shown in the attached drawings.

The various aspects discussed in this patent can be combined in order to provide additional advantages. Further, the person skilled in the art will understand that embodiments can be combined, and that also more than two embodiments can be combined. Furthermore, some of the features can form the basis for one or more divisional applications.

The invention claimed is:

1. A steam iron for treating garments, comprising:

a heel to rest the steam iron on a supporting surface (S) when the steam iron is not treating garments;

a pressurisation unit having a chamber, the chamber comprising a water inlet for receiving water and a water outlet, the pressurisation unit comprising a mechanical energy storing element coupled to a pusher element for inducing the storage of mechanical energy in the mechanical energy storing element, the pressurization unit being adapted to:

a) in a rest position (P1) where the heel is placed on the supporting surface (S), generate an air vacuum in the chamber to draw water into the chamber via the water inlet due to the pusher element pushing against the mechanical energy storing element, b) in a lifted position (P2) where the heel is not placed on the supporting surface (S), pressurise the water drawn in the chamber using energy stored in the mechanical energy storing element when in the rest position (P1);

a steam engine for generating steam from water towards the garments; and a water output channel for carrying water under pressure from the water outlet to the steam engine.

2. A steam iron according to claim 1, wherein the pressurisation unit comprises:

a piston sliding within the chamber in a first direction (D1) to create said air vacuum; and retention member located in the chamber to exert a force on the piston in a second direction (D2), opposite the first direction (D1).

3. A steam iron according to claim 2, wherein the retention member comprises a compression spring that is compressed when the steam iron is in its rest position (P1) and released when the iron is in its lifted position (P2).

4. A steam iron according to claim 1, comprising a one-way valve disposed along the water output channel to allow water to flow in the direction of the steam engine.

5. A steam iron according to claim 4, wherein the one-way valve is adapted to be opened based on a user action.

6. A steam iron according to claim 4, wherein the one-way valve is adapted to self-open in the lifted position (P2).

7. A steam iron according to claim 1, wherein the chamber is adapted to resiliently deform in the rest position (P1) to create said air vacuum in the chamber.

8. A steam iron according to claim 2, wherein the pusher element is connected to the piston, and the pusher element extends beyond the heel when the retention member is released.

9. A steam iron according to claim 1, further comprising:

a water reservoir; and a water input channel for carrying water from the water reservoir to the chamber via the water inlet in the rest position (P1) and under the action of the pressurisation unit.

10. A steam iron system (1A, 1B, 1C) comprising:

a steam iron according to claim 1, and a docking station defining said supporting surface (S) for detachably resting the steam iron.

11. A steam iron system according to claim 10, wherein the steam iron comprises:

a water reservoir; and a water input channel for carrying water from the water reservoir to the chamber via the water inlet in the rest position (P1) and under the action of the pressurisation unit.

12. A steam iron system according to claim 10, wherein the docking station comprises a water reservoir, the steam iron and the docking station each including a fluid coupling cooperating when the steam iron is in the rest position (P1), for carrying water from the water reservoir (12A) of the docking station to the chamber via the water inlet in the rest position (P1) and under the action of the pressurisation unit.

13. A steam iron system according to claim 10, wherein the steam iron comprises an inlet valve arranged at the entrance of the water inlet to prevent water in the chamber flowing back to the reservoir (12, 12A) when the steam iron is in the lifted position (P2).

14. A steam iron system according to claim 10, wherein:

the steam iron comprises an electric heater in thermal conductivity with the steam engine; and the docking station comprises a power supply, the steam iron and the docking station having electrical connectors cooperating with each other to provide electrical supply to the electric heater when the steam iron is in the rest position (P1).

* * * * *